US007376482B2

(12) United States Patent
Ido

(10) Patent No.: US 7,376,482 B2
(45) Date of Patent: May 20, 2008

(54) GRINDING METHOD AND APPARATUS

(75) Inventor: Masahiro Ido, Kariya (JP)

(73) Assignee: Jtekt Corporation, Osaka-shi (JP)

( * ) Notice: Subject to any disclaimer, the term of this patent is extended or adjusted under 35 U.S.C. 154(b) by 32 days.

(21) Appl. No.: 11/454,932

(22) Filed: Jun. 19, 2006

(65) Prior Publication Data

US 2006/0287756 A1 Dec. 21, 2006

(30) Foreign Application Priority Data

Jun. 21, 2005 (JP) ..... 2005-181144

(51) Int. Cl.
*G06F 19/00* (2006.01)

(52) U.S. Cl. ..... 700/164; 700/159; 451/5; 451/251

(58) Field of Classification Search ..... 700/159, 700/160, 164; 451/1, 5, 11, 251
See application file for complete search history.

(56) References Cited

U.S. PATENT DOCUMENTS 4,484,413 A 11/1984 Yamamoto et al.
5,018,071 A * 5/1991 Kihara et al. ..... 700/164
5,465,474 A * 11/1995 Kimura et al. ..... 29/6.01
5,595,525 A * 1/1997 Hayashi et al. ..... 451/5
5,691,909 A * 11/1997 Frey et al. ..... 700/159
6,306,018 B1 * 10/2001 Coverdale et al. ..... 451/49
6,382,062 B1 * 5/2002 Smith ..... 83/74
6,409,573 B1 * 6/2002 Mukai et al. ..... 451/5
6,711,829 B2 * 3/2004 Sano et al. ..... 33/549

FOREIGN PATENT DOCUMENTS

JP 2-124254 5/1990

* cited by examiner

*Primary Examiner*—Alexander Kosowski
(74) *Attorney, Agent, or Firm*—Oblon, Spivak, McClelland, Maier & Neustadt, P.C.

(57) ABSTRACT

In a grinding method and apparatus, a machining portion of a workpiece is ground with a grinding wheel on a trial, and shape errors in respective rotational phases of the machining portion are measured after the trial grinding. Based on the shape errors, control data defining workpiece rotational speeds for respective rotational phases of the workpiece is prepared so that the workpiece rotational speed is made to be slow for a rotational phase in which the machining portion is undercut, but to be fast for another rotational phase in which the machining portion is overcut, and the machining portion of the workpiece is ground as the rotational speed of the workpiece is controlled in accordance with the control data.

7 Claims, 5 Drawing Sheets

GRINDING METHOD AND APPARATUS

INCORPORATION BY REFERENCE

This application is based on and claims priority under 35 U.S.C. 119 with respect to Japanese Application No. 2005-181144 filed on Jun. 21, 2005, the entire content of which is incorporated herein by reference.

BACKGROUND OF THE INVENTION

1. Field of the Invention

The present invention relates to a grinding method and apparatus capable of grinding a workpiece at high shape accuracy by controlling the rotation of the workpiece.

2. Discussion of the Related Art

Generally, in a grinding operation of a slender workpiece, the grinding resistance acting on a grinding wheel causes the workpiece to flex or yield when being grater than the rigidity of the workpiece. With the flexure, the workpiece is deviated from a grinding center, and an infeed amount of the grinding wheel against the workpiece cannot be a programmed grinding allowance. A problem arises from this in that the deviation of the workpiece causes errors in dimension as well as shape accuracy (e.g., roundness).

To cope with the aforementioned problem, as shown in FIGS. 8 and 9, steady rest devices 70 are provided at places which are selectively brought to face a grinding wheel 72, to enhance the machining accuracy by preventing the workpiece 74 from flexing.

However, the steady rest devices 70 need fine adjustments each time the kind of the workpieces is changed, so that a lot of time is required in altering the setup for the workpieces of a new kind. Further, for the grinding of a cylindrical workpiece 74 with the steady rest devices 70, the positions of rest shoes have to be controlled to follow the workpiece whose diameter changes with the progress of the grinding operation, thereby making the steady rest devices 70 complicated and expensive.

Therefore, a grinding machine disclosed in Japanese unexamined, published patent application No. 2-124254 has been developed as a technology for performing a grinding operation without using any such steady rest device. In the technology, there are used rotational position detecting means for detecting the rotational position of a workpiece and grinding resistance altering means for altering the grinding resistance, and by these means, the grinding resistance is controlled to be decreased at each rotational phase in which a grinding part (i.e., arc segment) is narrowed in the substantial grinding width due to the opening an oil hole thereon, so that each grinding part with the oil hole opening thereat can be prevented from being infed deeper than other non-holed parts (arc segments) of the workpiece. In this case, there can be conceived of various grinding resistance altering means for altering the grinding resistance upon grinding each local area at which the oil hole 6 opens. The various means include means for varying the rotational speed of the workpiece about the axis of the same or the rotational speed of the grinding wheel, means for varying the infeed amount of a wheel head, or means for varying the compliance of bearings which rotatably support the workpiece or grinding wheel bearings.

For a cylindrical workpiece with the oil hole opening at known angular phases, the technology described in the Japanese application has been designed to prevent each arc part with the oil hole from suffering a deep infeed by partially controlling the fluctuation of the grinding resistance caused by the oil hole for the period of each particular angular phase. However, nothing is described in the Japanese application about a grinding method of enhancing the shape accuracies in respective rotational phases of a workpiece of the property that the continuous variation in rigidity causes the workpiece to be overcut or undercut locally on the circumference thereof.

SUMMARY OF THE INVENTION

It is therefore a primary object of the present invention to provide an improved grinding method and apparatus capable of grinding a workpiece at high shape accuracy by preventing the workpiece from deviating due to grinding resistance.

Briefly, according to the present invention, there is provided a grinding method in a grinding apparatus which comprises a workpiece support device for supporting a workpiece to be rotatable about an axis and a wheel head carrying a rotating grinding wheel and wherein the workpiece support device and the wheel head are fed relative to each other in a direction traversing the axis for grinding a machining portion of the workpiece with the grinding wheel at a grinding point. The grinding method comprises steps of determining rigidity values in respective rotational phases of the machining portion of the workpiece and grinding the machining portion while controlling the rotational speed of the workpiece about the axis so that the rotational speed of the workpiece is made to be slow for a rotational phase in which the rigidity of the workpiece is low, but to be fast for another rotational phase in which the rigidity of workpiece is high.

Workpieces have a tendency that as the grinding resistance becomes large with an increase in the rotational speed of a machining portion, the workpiece during a grinding operation goes away from the grinding wheel to have a large shape error, while as the grinding resistance becomes small with a decrease in the rotational speed, the workpiece comes to have a small shape error. With the construction of the present invention taking the tendency of the workpiece into account, the control data defining the respective rotational speeds for respective rotational phases of the machining portion is prepared so that the workpiece rotational speed is made to be slow for a rotational phase in which the machining portion of the workpiece is low in rigidity and is anticipated to be undercut, but to be fast for another rotational phase in which the machining portion of the workpiece is high in rigidity and is anticipated to be overcut. Then, the grinding operation is performed as the workpiece rotational speed is controlled in accordance with the control data. Accordingly, it can be realized to grind the machining portion at high shape accuracy over the circumference of the machining portion.

In another aspect of the present invention, there is provided a grinding apparatus comprising a workpiece support device for supporting a workpiece to be rotatable about an axis, a wheel head carrying a rotating grinding wheel, a workpiece driver for drivingly rotating the workpiece, and a feed mechanism for feeding the workpiece support device and the wheel head toward each other in a direction traversing the axis for grinding a machining portion of the workpiece with grinding wheel at a grinding point. The grinding apparatus further comprises a memory for storing control data which defines workpiece rotational speeds for respective rotational phases of the workpiece so that the workpiece rotational speed is made to be slow for the rotational phase in which the rigidity of the workpiece is low, but to be fast for the rotational phase in which the rigidity of workpiece is high and a numerical controller for controlling the feed mechanism and the workpiece driver to grind the machining portion as the workpiece is rotated at the workpiece rotational speeds defined for respective rotational phases of the workpiece in accordance with the control date stored in the memory.

With the construction in the second aspect of the present invention, the grinding operation is performed in accordance with the control data which defines the workpiece rotational speeds for the respective rotational phases of the workpiece so that the workpiece rotational speed is made to be slow for the rotational phase in which the machining portion is low in rigidity and is anticipated to be undercut, but to be fast for another rotational phase in which the machining portion is high in rigidity and is anticipated to be overcut. Therefore, it can be realized to provide a grinding apparatus which is capable of grinding the machining portion at high shape accuracy over the circumference of the machining portion.

BRIEF DESCRIPTION OF THE DRAWINGS

The foregoing and other objects and many of the attendant advantages of the present invention may readily be appreciated as the same becomes better understood by reference to the preferred embodiments of the present invention when considered in connection with the accompanying drawings, wherein like reference numerals designate the same or corresponding parts throughout several views, and in which.

DETAILED DESCRIPTION OF THE PREFERRED EMBODIMENTS

Figure 1:
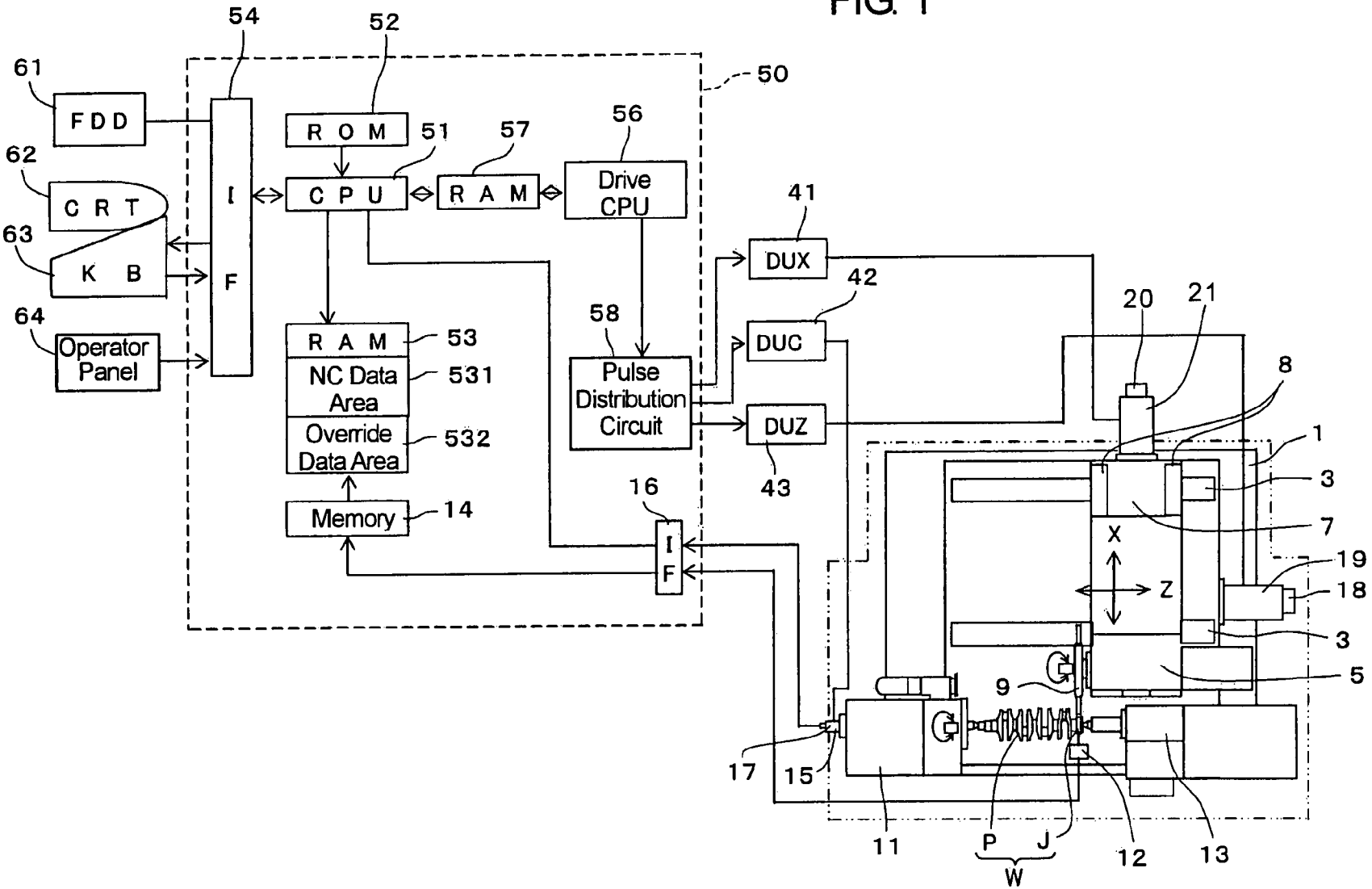
FIG. 1 is a schematic plan view a grinding machine according to the present invention, also showing a general block diagram of a numerical controller therefor.
Figure 2:
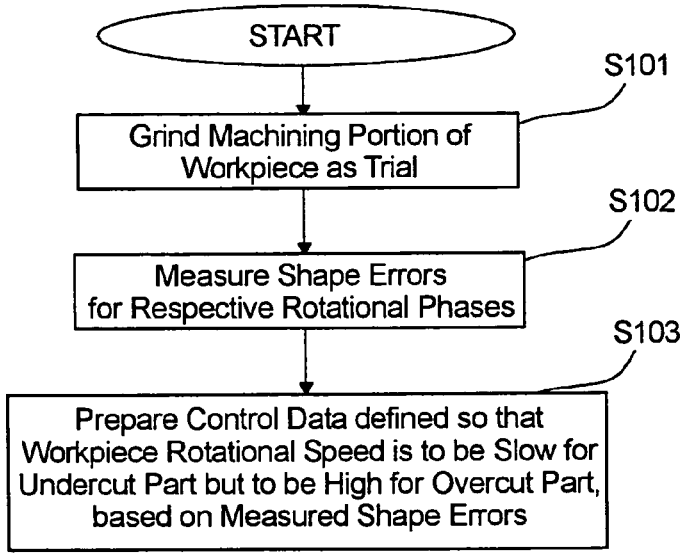
FIG. 2 is a flow chart showing the preparation procedure for workpiece speed control data in the first embodiment according to the present invention.

Hereafter, the first embodiment wherein a grinding method and apparatus according to the present invention is applied to the grinding of journal portions of a crankshaft will be described with reference to the accompanying drawings. FIG. 1 is a schematic plan view of a grinding machine according to the present invention, also showing a general block diagram of a numerical controller therefor, and FIG. 2 is a flow chart showing the preparation procedure for workpiece speed control data in the first embodiment according to the present invention.

A bed 1 of the grinding machine is provided thereon with a pair of Z-axis guide rails 3 extending in a lengthwise direction (Z-axis direction), and a Z-axis table 7 is provided to be movable on and along the Z-axis guide rails 3 in the Z-axis direction. A first feed screw shaft (not shown) is provided for moving the Z-axis table 7 in the Z-axis direction, and a servomotor 19 with an encoder 18 is connected to a right end portion of the first feed screw shaft. The Z-axis table 7 is provided thereon with a pair of X-axis guide rails 8 extending in an X-axis direction perpendicular to the Z-axis direction. A wheel head 5 rotatably carrying a grinding wheel 9 is mounted to be slidable on and along the X-axis guide rails 8. Another or second feed screw shaft (not shown) is provided for moving the wheel head 5 in the X-axis direction. A servomotor 21 with an encoder 20 is connected to an end portion of the second feed screw shaft. The servomotors 19 and 21 are connected to a Z-axis motor control circuit (DUZ) 43 and an X-axis motor control circuit (DUX) 41, respectively.

Ahead of the wheel head 5, there are mounted a work head 11 and a foot stock 13 spaced in the lengthwise direction, between which a crankshaft W as workpiece is supported by a pair of left and right centers.

The work head 11 is provided with a chuck (not shown) which grips or clamps one end of the crankshaft W in such a state that the center of journal portions J on the axis of the workpiece (crankshaft) W is in coincidence with the rotational center of the workpiece W. The chuck is drivingly connected to a C-axis rotation servomotor 15 for rotationally driving the crankshaft W. An encoder 17 is provided at a rear end of the C-axis rotation servomotor 15 for detecting the rotational phase of the crankshaft W. The rotational phase detected by the encoder 17 is transmitted to a main CPU 51 through an interface 16, as referred to later. The C-axis rotation servomotor 15 is connected to a C-axis motor control circuit (DUC) 42. Further, the crankshaft W has a reference line defined as a line segment encompassing the center of the journal portions J (journal center) and a shape center of each pin portion P, and the crankshaft W is joined with the chuck with the reference line being oriented in a predetermined rotational phase. The foot stock 13 pushes and supports the journal center of the crankshaft W through its center. At a position to face the grinding wheel 9 with the crankshaft W placed therebetween, there is provided a roundness measuring device 12 for measuring the shape accuracy of each ground surface of the crankshaft W. Measured data on the shape accuracy is transmitted from the roundness measuring head 12 through the interface 16 to a memory device 14.

Next, a control system for controlling the grinding machine in the present embodiment will be described. The control system includes a numerical controller 50, which is provided with the main CPU 51 for controlling the grinding machine, a ROM 52 for storing control programs, a RAM 53 for storing NC data and other data, and other circuit components. Signals from a floppy disc drive (FDD) 61, a CRT display 62, a keyboard 63 and an operator panel 64 are inputted to the numerical controller 50 through an interface 54. In addition to the main CPU 51, the numerical controller 50 is further provided with a drive CPU 56 for controlling the servomotors 15, 19, 21, and the drive CPU 56 is connected to the main CPU 51 through another or second RAM 57. The drive CPU 56 outputs command pulses to the respective motor control circuits 41 to 43 through a pulse distribution circuit 58.

Since in the present embodiment, the rotational speed control of the workpiece W is carried out in each of respective rotational phases, the RAM 53 of the main CPU 51 is provided with an override data area 532 for storing override data in addition to an NC data area 531 provided conventionally. The shape accuracy data transmitted to the memory device 14 is converted into override rotational speed data for respective rotational phases, and the override rotational speed data is stored in the override data area 532.

Hereafter, description will be made regarding the procedure in preparing control data which is used for grinding journal portions J of the crankshaft W in the construction as described above. First of all, as shown in FIG. 2, a trial grinding is performed on a machining portion of the crankshaft W as workpiece. To this end, with the crankshaft W being supported between the work head 11 and the foot stock 13, the Z-axis table 7 with the wheel head 5 mounted thereon is moved by the servomotor 19 and is positioned to make the grinding wheel 9 face the machining portion to be ground. In this particular embodiment, a journal portion is to be ground, wherein the Z-axis table 7 is positioned to align the grinding wheel 9 with the journal portion J which is at the rightmost end as viewed in FIG. 1. Then, a work spindle (not shown) of the work head 11 is driven by the C-axis rotation servomotor 15, and the crankshaft W is rotated about the journal center. At this time, the center of the shape to be ground on the journal portion J lies on the rotational center of the crankshaft W and thus, rotates without orbiting therearound. Then, the grinding wheel 9 is rotated, and the wheel head 5 (i.e., the grinding wheel 9) is advanced by the servomotor 21 toward the journal portion J to grind the same into a cylindrical shape as a trial (step S101). During the trial grinding, various options may selectively be taken so that (i) the workpiece rotational speed is held to be constant, (ii) the workpiece rotational speed is controlled to make the grinding speed (the speed in tangential direction of the grinding wheel relative to the workpiece) constant, or (iii) the workpiece rotational speed is controlled to make the grinding efficiency (the chip removal amount per unit time) constant.

Figure 4:
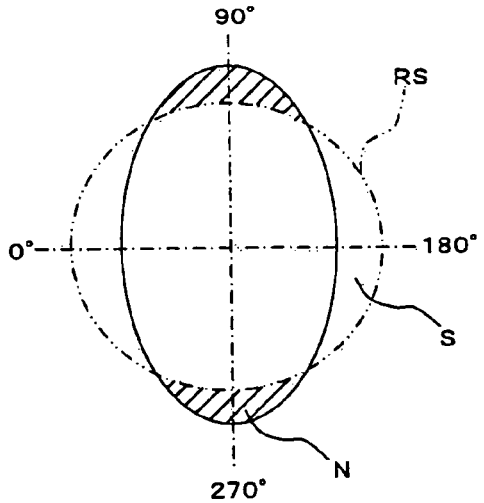
FIG. 4 is an explanatory view showing the shape accuracy of a machining portion of a workpiece measured after grinding in an exaggerated scale.

Then, the journal portion J which was ground as a trial is measured for shape errors. The measurement is performed for example by the existing roundness measuring device 12 of a contact type using probes or a non-contact type using laser beams. In this case, the center in shape of the journal portion J is taken as the center in measurement, and the shape accuracy (roundness) is measured in each of respective rotational phases beginning from a reference line SL which is taken as, e.g., a line segment SL0 encompassing the journal center Wo and the shape center Po of a predetermined pin portion P, as referred to later with reference to FIG. 6. The measured shape accuracies (roundness data) are compared with a theoretically desired circle RS as shown in FIG. 4, whereby undercut portions N and overcut portions S are gasped to be detected as the shape errors (step S102).

In this particular embodiment, since the measuring phases for measurement of the shape accuracies coincide respectively with the rotational phases for grinding operation, the shape errors detected in the respective measuring phases are compiled into control data which represents the shape errors in respective rotational phases during the rotation of the crankshaft W. The shape error data is calculated from the measured data of the shape accuracy which is transmitted as electrical signals from the measuring device 12 through the interface 16 and the memory device 14.

Then, rotational speeds at which the crankshaft W is to be rotated in respective rotational phases are determined based on the shape error data. More specifically, the rotational speeds are determined for respective rotational phases so that as shown in FIG. 4, the rotational speed is made to be slow for each phase having an undercut portion N but to be fast for each phase having an overcut portion S (step S103). Where the grinding of the workpiece portion after the trial grinding is to be performed as the workpiece rotational speed is controlled to make the grinding speed or the grinding efficiency constant like the aforementioned option (ii) or (iii) taken for the trial grinding, the workpiece rotational speeds which are determined for respective rotational phases in light of the aforementioned option (ii) or (iii) may be further determined to be varied for the purpose of correcting the undercut portion N and the overcut portion S.

Figure 5:
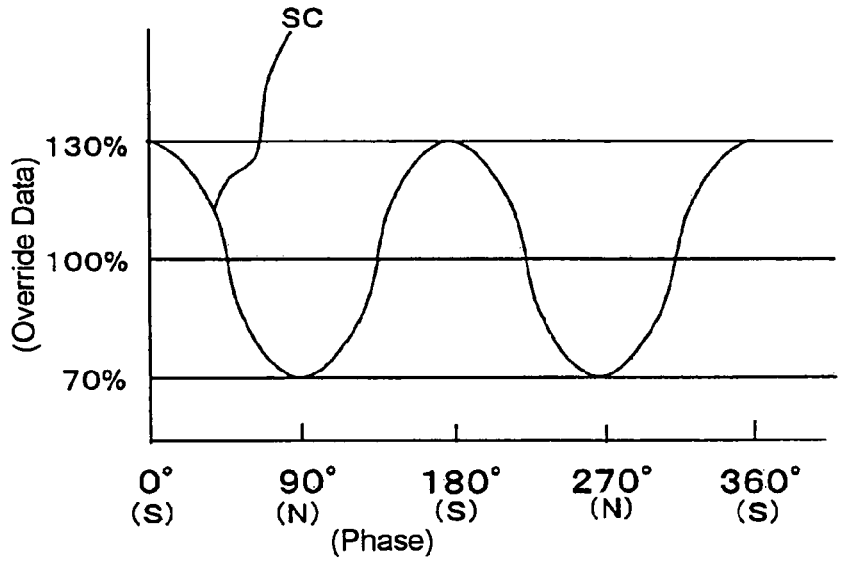
FIG. 5 is a graph showing override percentages or data defining workpiece rotational speeds for respective rotational phases of the machining portion.

Alternatively, there may be utilized an override function of the numerical controller 50 in determining the rotational speeds for this purpose. The override function has been known as a function of increasing or decreasing an actual feed or rotational speed by multiplying a certain coefficient (percentage) with a programmed feed or rotational speed designed in NC data. As shown in FIG. 5 for example, override data SC is so set that a programmed speed which has been set for all rotational phases is decreased to seventy percents (70%) thereof for the angular phases of 90 and 270 degrees each corresponding to the undercut portion N, but is increased to one hundred thirty percents (130%) thereof for the angular phases of 0 and 180 degrees each corresponding to the overcut portion S. By utilizing the override function, it becomes possible to vary the actual rotational speed of the work spindle easily over the circumference of the workpiece only by changing the value of percentage, so that the overcut and the undercut on the workpiece can be corrected for those workpieces different in, e.g., material.

Next, description will be made as to grinding the crankshaft W by controlling the workpiece rotational speed in accordance with the control data SC.

First of all, with the crankshaft W being supported between the work head 11 and the foot stock 13, the Z-axis table 7 with the wheel head 5 mounted thereon is moved by the servomotor 19 to bring the grinding wheel 9 into a position to face the journal portion J which has been ground as a trial to a dimension leaving a finish grinding allowance. The servomotor 19 connected to the Z-axis motor control circuit (DUZ) 43 is controlled by the number of pulses which are imparted from the drive CPU 56 thereto through the pulse distribution circuit 58 (step S201).

Then, the crankshaft W is rotated in response to a command value for rotation of the work spindle. At this time, a rotational speed value into which a command rotational speed value is converted by the override data SC is transmitted as the number of command pulses from the main CPU 51 through the RAM 57 to the drive CPU 56 and is further transmitted as the number of pulses for rotating the crankshaft W from the pulse distribution circuit 58 to the C-axis motor control circuit (DUC) 42. Command pulses of the number specified by the override data transmitted in this way cause the C-axis rotation servomotor 15 to rotate the work spindle, whereby the rotational speed of the crankshaft W is controlled for each of the respective rotation phases. Then, the grinding wheel 9 is rotated, and the wheel head 5 is moved toward the crankshaft W to grind the journal portion J of the crankshaft W to a finish dimension. At this time, the wheel head 5 is moved by the servomotor 21, and the servomotor 21 connected to the X-axis motor control circuit (DUX) 41 is controlled by the number of pulses which are imparted from the drive CPU 56 through the pulse distribution circuit 58 (step S202).

By performing the grinding in this way, it becomes possible to decrease the shape error which is caused by the action that the machining portion J goes away from the grinding wheel 9 as a result of being flexed due to the grinding resistance. As a consequence, the journal portion J of the crankshaft W can be ground at high shape accuracy over the circumference thereof.

Subsequently, with respect to each of other machining portions J of the crankshaft W, a grinding operation is performed with the rotational speed of each machining portion J being controlled in accordance with the already prepared control data SC in the same manner as described above.

Second Embodiment

Next, the second embodiment wherein the grinding method and apparatus according to the present invention is applied to the grinding of pin portions P of a crankshaft W will be described with reference to FIG. 6. The construction of the grinding machine is the same as that in the first embodiment and hence, the description of such construction will be omitted for the sake of brevity. In this particular embodiment, since ground as machining portions are the pin portions P each of which is eccentric by a predetermined distance from the rotational center (journal center) Wo on the axis of the crankshaft W as workpiece, the second embodiment differs from the first embodiment in the following respects.

In the second embodiment, the crankshaft W is supported between the work head 11 and the foot stock 13 to place the journal center Wo of the crankshaft W on the rotational center in the same manner as the first embodiment. Thus, when the crankshaft W is rotated about the journal center Wo for rotational center during the grinding of each pin portion P, the pin portion P eccentric from the journal portions J makes an orbit motion around the journal center Wo.

In this connection, in performing a grinding operation with the rotating grinding wheel 9, the wheel head 5 is given a form creation motion for grinding the pin portion P to a cylindrical shape as a trail by being moved back and forth by the servomotor 21 in synchronous relation with the orbit motion of the pin portion P.

The measurement of the shape accuracy after the trial grinding is performed to take the shape center Po of the pin portion P as the measuring center in the same manner as the foregoing first embodiment. However, the second embodiment differs from the foregoing first embodiment in the preparation of the control data which defines the workpiece rotational speeds in the respective rotational phases, as described below.

Figure 6:
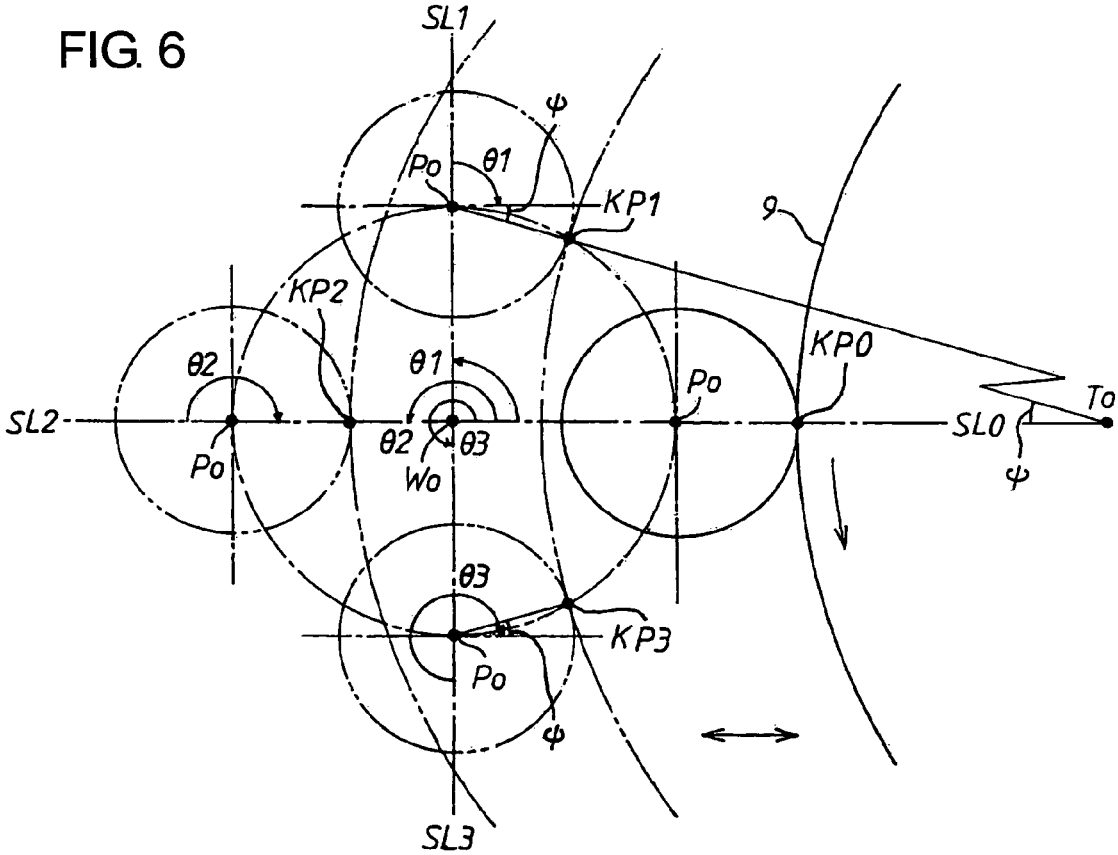
FIG. 6 is a schematic chart showing the geometrical relation between rotational phases of a machining portion eccentric from the rotational center of a workpiece and measuring phases of the machining portion in the second embodiment according to the present invention.

As shown in FIG. 6, the reference line SL is taken as a line segment encompassing the journal center Wo and the shape center Po of the pin portion P. When the crankshaft W takes a certain phase (rotational phase) to which it is rotated by an angle ($\theta$) around the journal center Wo, it results that the phase (measuring phase) of a circumferential point of the pin portion P which point is on the grinding point KP deviates by an angle ($\phi$) from the angle ($\theta$). The angle ($\phi$) is defined as the angle which the line segment passing through the center To of the grinding wheel 9 and the shape center Po of the pin portion P makes with a reference line SL0 (i.e., the reference line SL having the grinding wheel center To thereon).

For example, when the crankshaft W is rotated an angle $\theta 1$ (90 degrees) in the counterclockwise direction, the reference line SL0 moves to a reference line SL1 at the twelve-o'clock position, and the rotational phase being the phase of the reference line SL1 advances the angle $\theta 1$, whereas the measuring phase on the grinding point KP1 of the pin portion P advances by an angle of $\theta 1+\phi$ in the clockwise direction relative to the reference line SL1. Further, when the crankshaft W is rotated another angle $\theta 2$ (180 degrees), the angle $\phi$ becomes zero degree, whereby the measuring phase on the grinding point KP2 at that time advances by the angle $\theta 2$ in the clockwise direction relative to a further rotated reference line SL2. Further, when the crankshaft W is rotated another angle $\theta 3$ (270 degrees) in the counterclockwise direction, the measuring phase on the grinding point KP3 at that time advances by an angle of $\theta 3-\phi$ in the clockwise direction relative to a still further rotated reference line SL3. Accordingly, in the present embodiment, the shape error in the measuring phase corresponding to the circumference point of the pin portion P which point is on the grinding point KP and which point has been rotated by the angle of $\theta \pm \phi$ from the reference line SL is determined as the shape error in the corresponding rotational phase $\theta$. Thus, the setting of the workpiece rotational speeds for respective rotational phases are made based on the shape errors determined in this manner.

In accordance with an existing mathematical theorem, the value $\phi$ can be calculated and indicated as a function of the value $\theta$ based on a distance between the grinding wheel center To and the machining center Po of the pin portion P and another distance between the work spindle rotational center Wo and the machining center Po.

Thereafter, the grinding of the pin portion P is performed as the rotational speed of the crankshaft W is controlled in accordance with the control data. By controlling the rotational speed during the machining operation in accordance with the control data, the pin portion P which is eccentric from the rotational center (journal center) Wo of the crankshaft W can also be ground at high shape accuracy over the circumference thereof. Other respects in the second embodiment are the same as those in the foregoing first embodiment.

Third Embodiment

Figure 3:
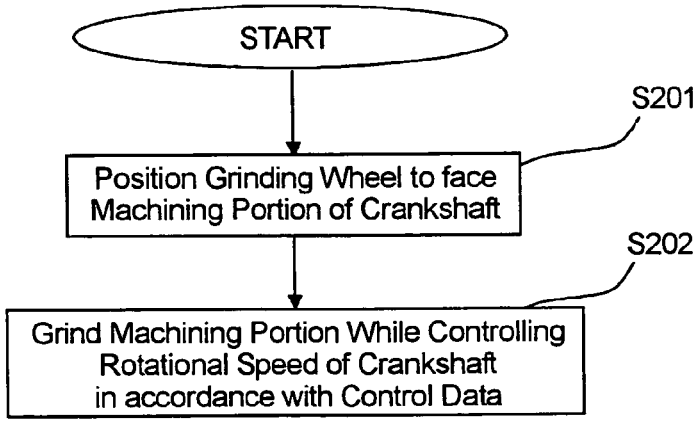
FIG. 3 is a flow chart showing grinding steps for executing a grinding operation while controlling the workpiece rotational speed in accordance with the workpiece speed control data.

Next, the third embodiment wherein the grinding method and apparatus according to the present invention is applied to the grinding of any or both of the journal and pin portions J, P of a crankshaft W will be described with reference to FIGS. 1, 3 and 7. The construction of the grinding machine is the same as that in the first embodiment and hence, the description of such construction will be omitted for the sake of brevity. In this particular embodiment, since the trial grinding operation as performed in the first and second embodiments is omitted, and instead, there are taken into account respective rigidity values Rv which the workpiece W has when angularly oriented in respective rotational phases.

Prior to the grinding operation on the grinding machine, a modeling and simulation technology well-known as Finite Element Method or the like will be utilized to determine the rigidity values Rv which the crankshaft W as workpiece has when taking the respective rotational phases, based on the material and shape data and the like of the crankshaft W. The technology is implemented by utilizing a computer incorporated in the numerical controller 50 or any computer outside, and in this particular embodiment, an external computer (not show) is used for this purpose. Specifically, as shown FIG. 7, the external computer has the material and shape data and the like of the crankshaft W input thereto and determines the rigidity values Rv of the crankshaft W when the same would have when positioned in respective rotational phases, in accordance with a modeling and simulation program (step S301). Then, the determined rigidity values Rv for the respective rotational phases are stored in a suitable storage medium such as a floppy disc, a USB memory, a DVD RAM and are inputted to the numerical controller 50 in a manner as well-known in the art.

In a modified form, the step of determining the rigidity values Rv may be realized without using any computer. That is, the crankshaft W is set between the work head 11 and the foot stock 13 with itself being clamped by the chuck (not shown). Then, the crankshaft W is rotationally indexed to take the respective rotational phases, in each of which the crankshaft W is pushed or pulled in a direction away from the wheel head 5. This can be done for example by exerting a given force on a center journal portion J of the crankshaft W in a direction away from the wheel head 5 with the crankshaft W indexed in each rotational phase and by measuring the deformation amount of a fixed portion on the crankshaft W with a suitable measuring gauge. In this case, the given force can be exerted on the crankshaft W by pulling the same in a horizontal direction opposite to the direction toward the wheel head 5 or by causing the wheel head 5 to push the crankshaft W through a suitable push rod or member temporally attached to the wheel head 5. Then, the rigidity values Rv in the respective rotational phases of the crankshaft W can be determined based on the deformation values and are inputted to the numerical controller 50 through a suitable storage medium.

Then, the determined workpiece rigidity values Rv are taken as the base to prepare control data which defines workpiece rotational speeds for the respective rotational phases so that the workpiece rotational speed is made to be slow for the rotational phase in which a machining portion (i.e., the journal portion J or the pin portion P) is anticipated to be undercut, but to be fast for the rotational phase in which the machining portion J, P is anticipated to be overcut (step S302). The undercut takes place for the rotational phase (each of 90 and 270 degree positions in FIG. 4) in which the workpiece W is weak in rigidity to be yieldable to the grinding resistance, while the overcut takes places for the rotational phase (each of 0 and 180 degree positions in FIG. 4) in which the workpiece W is strong in rigidity to stand against the grinding resistance.

Then, in the same manner as mentioned earlier with reference to FIG. 3, the wheel head 5 is moved in the Z-axis direction to index the grinding wheel 9 before the machining portion J or P (step S201) and is advance toward the crankshaft W in the X-axis direction to grind the machining portion J or P as the rotational speed of the crankshaft W is controlled in accordance with the control data, and the rotational speed of the machining portion J, P is controlled to be slow for the rotational phase in which the machining portion J, P is anticipated to be undercut due to being weak in rigidity, but to be fast for the rotational phase in which the machining portion J, P is anticipated to be overcut due to being strong in rigidity (step S202). As a result, the machining portion J or P can be ground at high shape accuracy over the circumference thereof.

Modifications

In the foregoing second embodiment, the grinding of the eccentric pin portion P is carried out with the crankshaft W rotating about the journal center Wo selected as rotational center, the present invention is not limited to the grinding method. For example, in supporting the crankshaft W during the grinding operation, the crankshaft W may be carried by using an eccentric chuck or the like which holds the shape center Po of the pin portion P on the rotational center. In this modified form, the respective measuring phases of the circumferential point of the pin portion P which point is on the grinding point KP coincide with respective rotational phases of the crankshaft W during the grinding operation.

Further, although the foregoing embodiments take the form that the override data is calculated in the grinding machine of the embodiments, the present invention is not limited to the form. In a modified form, the override data may be calculated by a separate device and may be inputted from a suitable data reader such as the floppy disc drive (FDD) 61.

Furthermore, although the foregoing embodiments take the form wherein the grinding operation is performed without using any steady rest device, the present invention is not limited to the form. In another modified form, a steady rest device may be used, and in grinding a workpiece having anisotropy in rigidity, an allowance in a finish grinding for correcting the shape deterioration caused by a preceding rough grinding can be decreased by the use of the steady rest device thereby to shorten the grinding cycle time.

Moreover, although the foregoing embodiments take the form that the roundness is measured on the grinding machine, the present invention is not limited to the on-machine measurement. In a further modified form, the roundness may be measured by a separate measuring device provided outside, and the measured result of the roundness may be inputted from a suitable data reader such as the floppy disc drive (FDD) 61 together with phase information obtained at the time of measurement.

Various features and many of the attendant advantages in the foregoing embodiments will be summarized as follows:

In the grinding method in the foregoing first embodiment typically shown in FIGS. 2 through 5, the control data SC defining the respective rotational speeds for respective rotational phases of the machining portion J is prepared (step S103) so that the workpiece rotational speed is made to be slow for each rotational phase N in which the workpiece W is undercut, but to be fast for each rotational phase S in which the workpiece W is overcut. Then, the grinding operation is performed (step S202) as the workpiece rotational speed is controlled in accordance with the control data SC. Accordingly, it can be realized to grind the machining portion J at high shape accuracy over the circumference of the machining portion J.

Also in the grinding method in the foregoing first embodiment typically shown in FIGS. 2 through 5, by grinding the workpiece W as a trial and then, by measuring the shape accuracy of the machining portion J after the trial grinding, the shape errors compared with a theoretically desired circle RS are detected for the respective rotational phases of the machining portion J. Based on the highly accurate shape error data detected in this way, the control data SC defining the respective rotational speeds for the respective rotational phases is prepared so that the rotational speed of the machining portion J is made to be slow for the rotational phase N in which the machining portion J is anticipated to be undercut, but to be fast for the rotational phase S in which the machining portion J is anticipated to be overcut. Then, the grinding operation is performed as the rotational speed of the workpiece W is controlled in accordance with the control data SC, so that the machining portion can be ground at high accuracy over the circumference thereof.

Further, in the grinding method in the foregoing first and second embodiments typically shown in FIG. 5, since the workpiece rotational speed is controlled by utilizing the override function, it can be realized to easily control the workpiece rotational speeds for the respective rotational phases over the circumference of the machining portion J, P. It can be also realized to coop workpieces of various kinds easily by altering the value of override percentage to meet the workpiece material, the grinding wheel specifications, the grinding allowance and the like.

Further, in the grinding method in the foregoing first embodiment typically shown in FIG. 4, since the rotational center of the workpiece W is coaxial with the machining portion J, the shape center of the machining portion J coincides with the rotational center of the workpiece W. In this case, the measuring phases for the shape accuracies in the respective rotational phases of the machining portion J coincide respectively with the respective rotational phases of the machining portion J during the grinding operation, so that the control data SC can be prepared easily as the shape errors which are detected respectively when the workpiece W is rotated to the respective rotational phases.

Further, in the grinding method in the foregoing second embodiment typically shown in FIG. 6, since the machining portion P is eccentric from the rotational center Wo of the workpiece W, the eccentric machining portion P makes the orbit motion around the rotational center Wo of the workpiece W when the same is rotated about the rotational center Wo during the grinding operation. In this connection, during the grinding of the eccentric machining portion P with the rotating grinding wheel 9, the form creation motion is performed in which the grinding wheel 9 is moved back and forth in synchronous relation with the orbit motion of the machining portion P to grind the same into a cylindrical shape. In the second embodiment, the measuring phases for measuring the respective shape accuracies of the circumferential surface of the eccentric machining portion P formed by the grinding has to be taken into account separately from the respective rotational phases for the grinding operation which takes the workpiece rotational axis as the rotational center Wo. These measuring phases and these respective rotational phases have differences due to the machining portion P being eccentric. For this reason, in each of the rotational phases of the workpiece W, a shape error in the measuring phase of a circumferential point of the machining portion P which point is on the grinding point KP is used as the shape error which the workpiece W has in the rotational phase corresponding to the circumferential point, and control data SC defining respective rotational speeds is prepared so that the rotational speed is made to be slow for the rotational phase in which the machining portion P is undercut, but to be fast for the rotational phase in which the machining portion P is overcut. The grinding operation is performed as the rotational speeds in the respective phases are controlled in accordance with the control data SC, whereby the machining portion P eccentric from the rotational center Wo of the workpiece W can also be ground at high shape accuracy over the circumference thereof.

Figure 7:
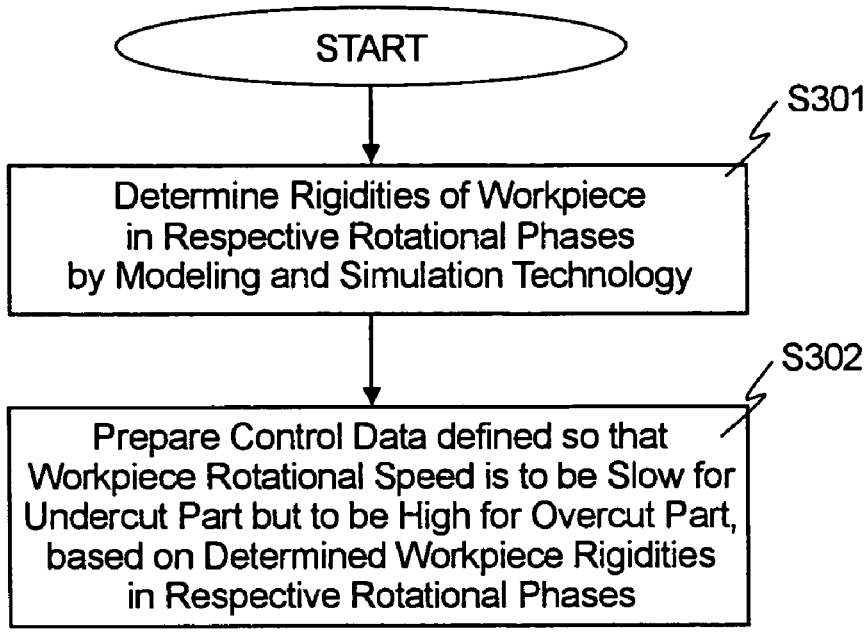
FIG. 7 is a flow chart showing the preparation procedure for workpiece speed control data in the third embodiment according to the present invention.
Figure 8:
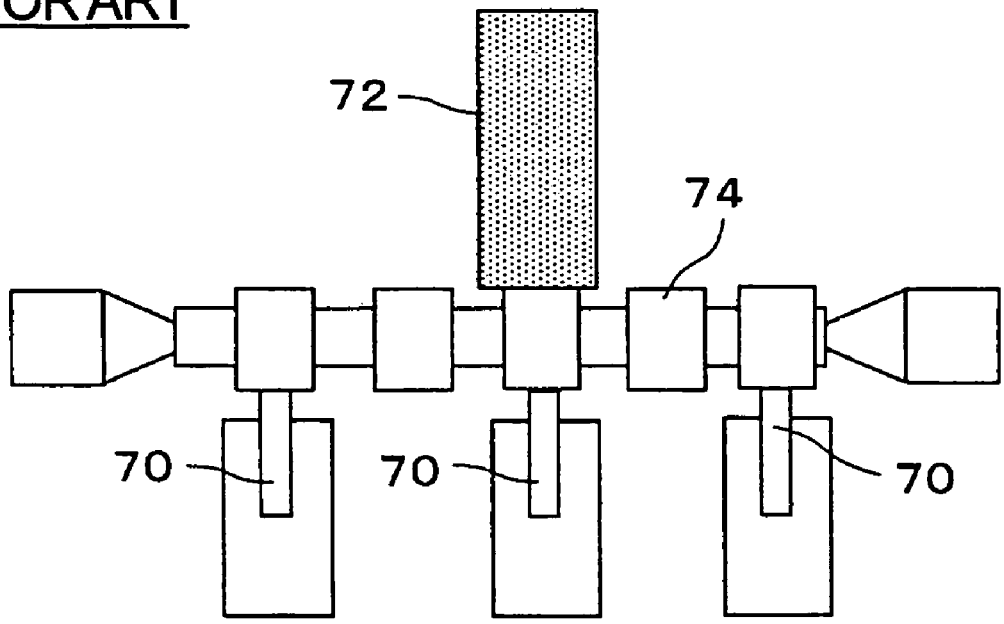
FIG. 8 PRIOR ART
FIG. 8 is a schematic plan view in a prior art grinding machine.
Figure 9:
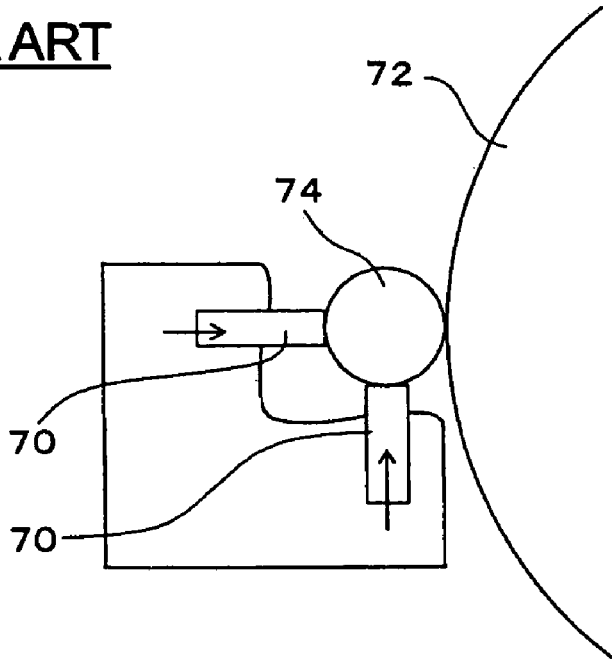
FIG. 9 PRIOR ART
FIG. 9 is a schematic side view of the prior art grinding machine.

Further, in the grinding method in the foregoing third embodiment typically shown in FIG. 7, the rigidity values Rv in the respective rotational phases of the machining portion J, P are determined by a computer-aided modeling and simulation technology well-known such as for example Finite Element Method or the like which takes the material and shape data of the workpiece W as inputs thereto, the control data defining respective rotational speeds for respective rotational phases is prepared so that the rotational speed is made to be slow for the rotational phase in which the rigidity value Rv of the workpiece W is low, but to be fast for the rotational phase in which the rigidity value Rv of the workpiece W is high, and the grinding operation is performed with the workpiece rotational speed being controlled phase by phase in accordance with the control data. Therefore, those steps of performing the trial grinding and then measuring the shape errors can be omitted, nevertheless the machining portion J, P can be ground at high shape accuracy over the circumference of the machining portion J, P.

Additionally, in the grinding apparatus in the foregoing embodiments typically shown in FIGS. 1, 4 and 5, the control data SC defining the workpiece rotational speeds for respective rotational phases is prepared so that the rotational speed is made to be slow for each rotational phase in which the workpiece W is anticipated to be undercut, but to be fast for the rotational phase in which the workpiece W is anticipated to be overcut, and the numerical controller 50 controls the grinding machine to perform the grinding operation while controlling the rotational speed of the workpiece W in accordance with the control data SC. Therefore, it can be realized to provide the grinding machine which is capable of grinding the machining portion J, P at high shape accuracy over the circumference of the machining portion J, P.

Obviously, numerous further modifications and variations of the present invention are possible in light of the above teachings. It is therefore to be understood that within the scope of the appended claims, the present invention may be practiced otherwise than as specifically described herein.

What is claimed is:

1. A grinding method in a grinding apparatus which comprises a workpiece support device for supporting a workpiece to be rotatable about an axis, and a wheel head carrying a rotating grinding wheel and wherein the workpiece support device and the wheel head are fed relative to each other in a direction traversing the axis for grinding a machining portion of the workpiece with the grinding wheel at a grinding point, the grinding method comprising steps of:

determining rigidity values in respective rotational phases of the machining portion of the workpiece, wherein the rotational phases comprise phases of a single 360° rotation of the workpiece; and grinding the machining portion while controlling the rotational speed of the workpiece about the axis so that the rotational speed of the workpiece is made to be slow for a rotational phase in which the rigidity of the workpiece is low, but to be fast for another rotational phase in which the rigidity of the workpiece is high.

2. The grinding method as set forth in claim 1, wherein the rigidity value determining step comprises:

grinding on a trial the machining portion of the workpiece with the grinding wheel;

measuring shape errors in respective rotational phases of the machining portion after the trial grinding; and determining the rigidity values using the measured shape errors so that the rigidity value of the machining portion is low for a rotational phase in which the machining portion involves undercut and so that the rigidity value of the machining portion is high for a rotational phase in which the machining portion involves overcut.

3. The grinding method as set forth in claim 1, wherein the rigidity values in respective rotational phases are determined based on data relating to the material and shape of the workpiece.

4. The grinding method as set forth in claim 1, wherein the control of the workpiece rotational speed is performed by overriding a rotational speed designated for the grinding of the machining portion.

5. The grinding method as set forth in claim 1, wherein the machining portion of the workpiece is a machining portion provided coaxially of the axis about which the workpiece is rotated.

6. The grinding method as set forth in claim 1, wherein the machining portion of the workpiece is a machining portion which is eccentric from the axis about which the workpiece is rotated.

7. A grinding apparatus comprising a workpiece support device for supporting a workpiece to be rotatable about an axis, a wheel head carrying a rotating grinding wheel, a workpiece driver for drivingly rotating the workpiece, and a feed mechanism for feeding the workpiece support device and the wheel head toward each other in a direction traversing the axis for grinding a machining portion of the workpiece with grinding wheel at a grinding point, the grinding apparatus further comprising:

a memory for storing control data which defines workpiece rotational speeds for respective rotational phases of the workpiece so that the workpiece rotational speed is made to be slow for the rotational phase in which the rigidity of the workpiece is low, but to be fast for the rotational phase in which the rigidity of workpiece is high, wherein the rotational phases comprise phases of a single 360° rotation of the workpiece; and a numerical controller for controlling the feed mechanism and the workpiece driver to grind the machining portion as the workpiece is rotated at the workpiece rotational speeds defined for respective rotational phases of the workpiece in accordance with the control data stored in the memory.

* * * * *